US005860551A

United States Patent [19]

Knott, Sr.

[11] Patent Number: 5,860,551

[45] Date of Patent: Jan. 19, 1999

[54] GABION CONTAINER

[76] Inventor: James M. Knott, Sr., 456 Hill St., Whitinsville, Mass. 01588

[21] Appl. No.: 826,714

[22] Filed: Apr. 7, 1997

[51] Int. Cl.[6] ..... B65D 6/22

[52] U.S. Cl. ..... 220/7; 220/492

[58] Field of Search ..... 220/485, 492, 220/494, 6, 7, 1.5, 4.28, 4.29, 4.31, 4.33

[56] References Cited

U.S. PATENT DOCUMENTS

| | | | |
|---|---|---|---|
| 2,804,227 | 8/1957 | E.T. Elfgren . | |
| 3,556,058 | 1/1971 | Smiler | 220/485 |
| 4,050,606 | 9/1977 | Jurasek | 220/485 |
| 4,324,172 | 4/1982 | Cazals et al. | 220/4.28 |
| 4,880,118 | 11/1989 | Petter | 220/485 |

*Primary Examiner*—Stephen J. Castellano
*Attorney, Agent, or Firm*—John E. Toupal; Harold G. Jarcho

[57] ABSTRACT

A container including a plurality of wire mesh wall panels having substantially planar sides and arranged to form an enclosure, adjacent panels having juxtaposed panel edges attached along a plurality of joints, a panel edge attached along at least some of the joints having wire ends forming loops each projecting through a mesh interstice a given distance beyond one planar side of an adjacent planar panel and each loop having a reentrant terminal portion extending back through the mesh interstice beyond an opposite planar side of the adjacent panel. Attaching the reentrant terminal portions on the opposite planar side of the adjacent panel is a retainer wire and a latch link extends through the loops on the one side of the adjacent panel.

29 Claims, 8 Drawing Sheets

GABION CONTAINER

BACKGROUND OF THE INVENTION

This invention relates generally to wire mesh containers and, more particularly, to wire mesh containers commonly known as gabions.

Typical gabions are baskets formed with wire mesh panels having interstices of about 3–4 inches. After being assembled at a construction site, the baskets are filled with stone of about 4–8 inches in diameter and laced together in suitable arrays. Such gabion assemblies are employed to create various structures including bridge abutments, retaining walls, channel linings, riverbank aprons, culvert headwalls, gravity walls, jetties, revetments, dams, sea walls, weirs and noise barriers.

Although quite versatile, conventional gabions exhibit certain disadvantages which restrict their use. For example, assembly of gabion panels at a construction site generally entails use of spiral fasteners, hog rings or tie wires. Each of these fastening methods is highly labor intensive and adds significantly to the cost of a final structure. In addition, the joints created by existing fastening methods often are deficient resulting in undesirable bulging of the filled gabion baskets.

The object of this invention, therefore, is to provide an improved wire mesh container which obviates problems associated with conventional gabions.

SUMMARY OF THE INVENTION

The invention is a container including a plurality of wire mesh wall panels having substantially planar sides and arranged to form an enclosure, adjacent panels having juxtaposed panel edges attached along a plurality of joints, a panel edge attached along at least some of the joints having wire ends forming loops each projecting through a mesh interstice a given distance beyond one planar side of an adjacent planar panel and each loop having a reentrant terminal portion extending back through the mesh interstice beyond an opposite planar side of the adjacent panel. Attaching the reentrant terminal portions on the opposite planar side of the adjacent panel is a retainer wire and a latch link extends through the loops on the one side of the adjacent panel. The provision of loops that receive a batch link greatly simplifies assembly of the wall panels.

According to certain features of the invention, wires forming the panels are dimensioned, shaped and arranged to provide a substantially rigid panel, the intersections of the wires are welded, the wires are disposed in a substantially orthogonal relationship and each of the joints includes loops. These features provide a highly stable container structure.

According to another feature of the invention, the container is formed by six rectangular panels arranged in an orthogonal relationship. The resulting structure has a block form easily used for building walls.

According to yet other features of the invention, the six panels include two panels having loops at all edges, two panels having loops at two edges, and two panels without loops. These features contribute to manufacturing and container assembly efficiency.

According to a further feature of the invention, each wall panel has a substantial majority of interstices of uniform size, and the interstice receiving each loop has a size substantially smaller than the uniform size. The smaller interstices function desirably to securely retain the loops while the larger interstices enhance wire material cost and efficiency.

According to yet a further feature of the invention, the panels are orthogonally arranged rectangular panels, the enclosure includes distinct cubic cavities separated by a rectangular wire mesh divider panel, and each edge of each divider panel has loops forming a joint. These features enhance the structural integrity of the wire mesh container.

According to an additional feature of the invention, the enclosure includes adjacent chambers each formed by five orthogonally arranged wall panels and having juxtaposed open ends closed by a single, rectangular wire mesh closure panel. The closure panel forms a common wall between the enclosure chambers to thereby minimize required wire mesh material.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENTS

Figure 1:
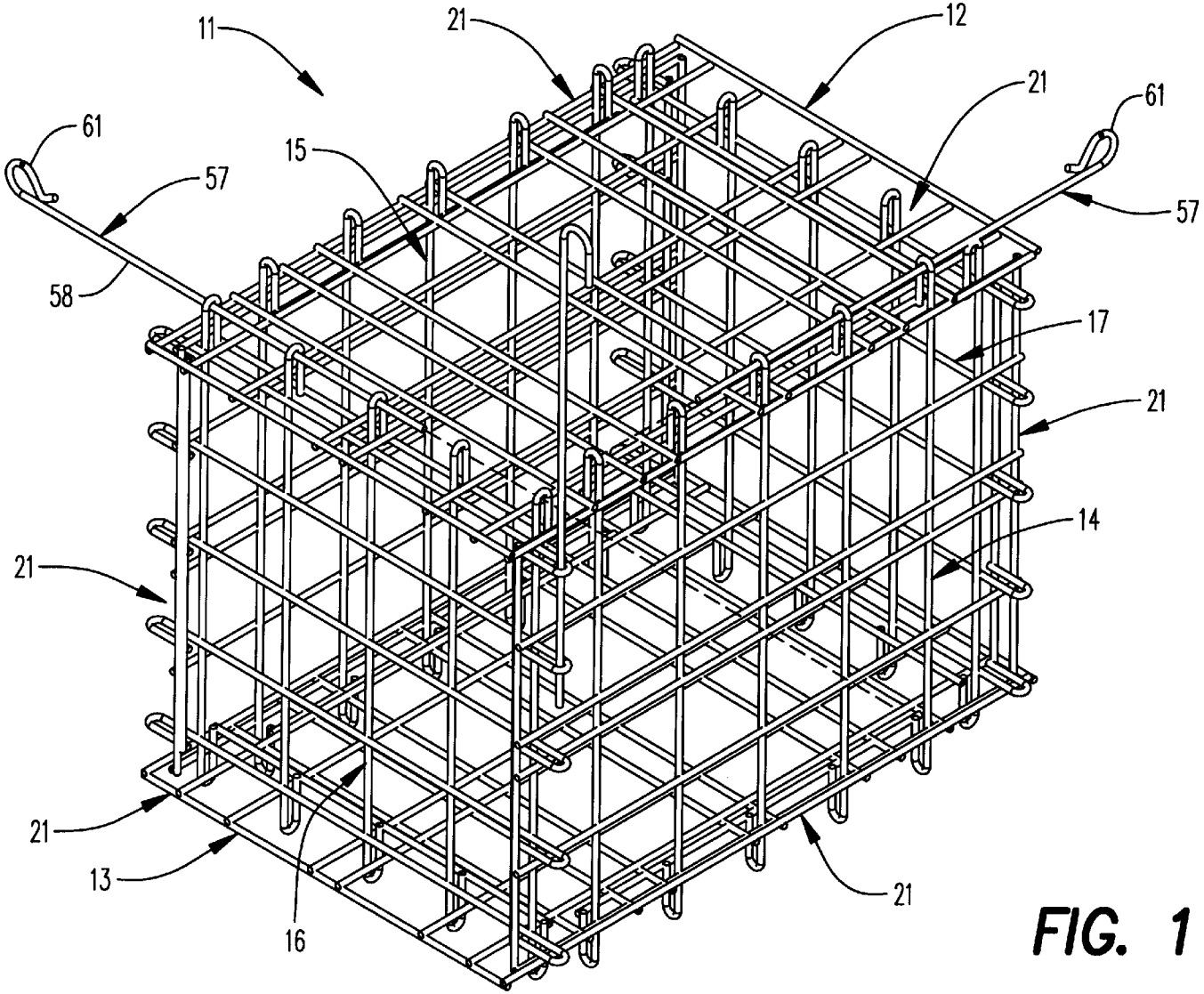
FIG. 1 is a diagramatic perspective view of a gabion container according to the invention.

A gabion container 11 is formed by a plurality of wire mesh wall panels including a top panel 12, a bottom panel 13, a front panel 14, a back panel 15 and a pair of side panels 16, 17. The wall panels 12–17 are rectangularly shaped, planar panels arranged in an orthogonal relationship to form an enclosure. Juxtaposed edges of the wall panels are attached in a manner described below to form rectilinear joints 21 of the container 11. Preferably, each of the panels 12–17 are formed of wires having a gauge sufficient to provide the panel with a substantial degree of rigidity. Also, desired structural rigidity is enhanced further by securely attaching intersections of the wires with a suitable welding process. It will be appreciated that FIG. 1 is diagramatic and does not include all structural features of the gabion 11 described hereinafter.

Figure 2:
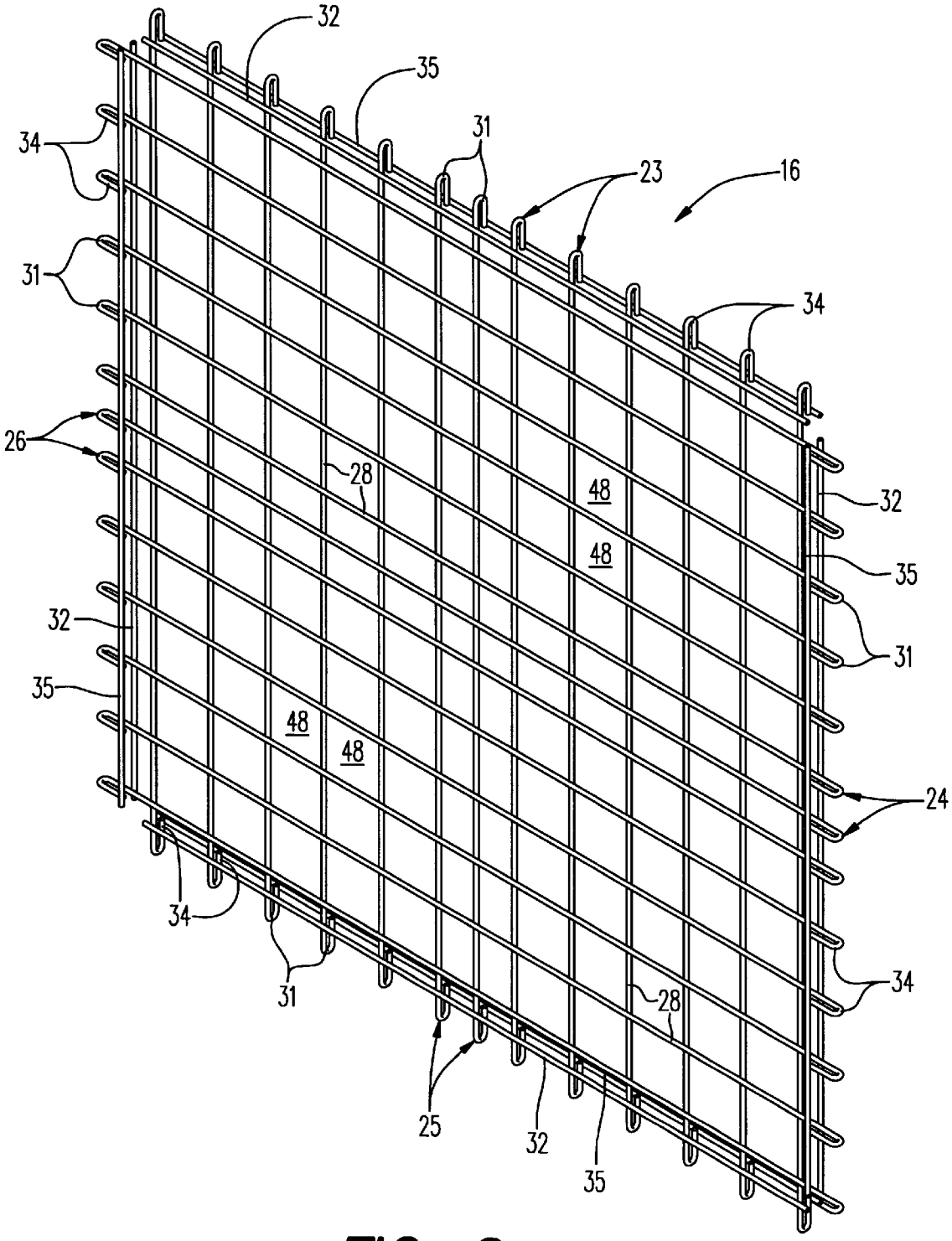
FIG. 2 is a perspective view of a side panel of the gabion shown in FIG. 1.

As illustrated in FIG. 2, wires 28 forming the side panel 16 have ends formed as loops 31 at each edge 23, 24, 25, 26 thereof. Each loop 31 extends from an attached cross wire 32 and has a reentrant terminal portion 34 that functions in a manner described below. Ends of the terminal loop portions 34 are attached by a retainer wire 35 having a function also described below. The side panel 17 is identical to the side panel 16 shown in FIG. 2 and therefore will not be described further.

Figure 3:
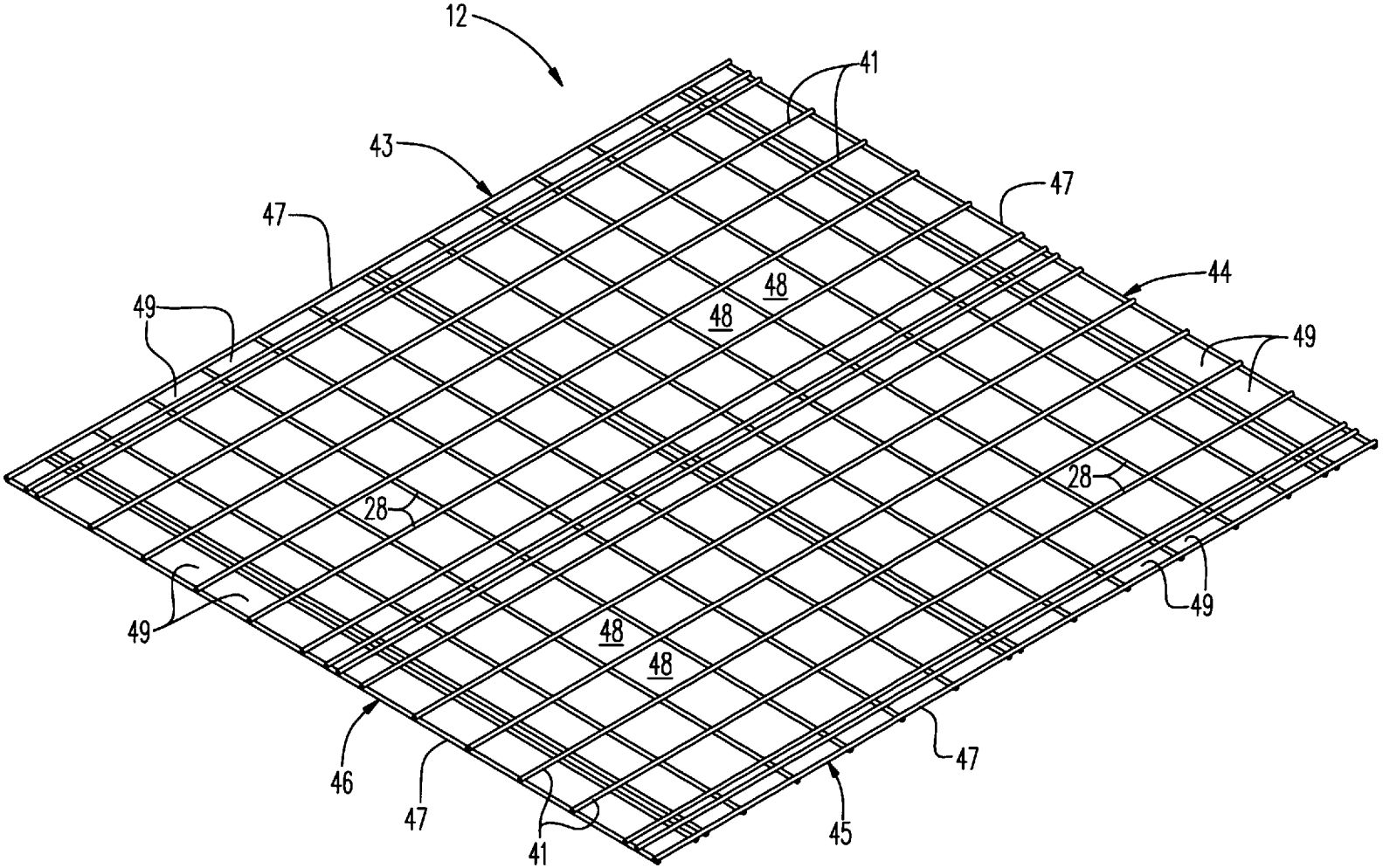
FIG. 3 is a top panel of the gabion shown in FIG. 1.

As illustrated in FIG. 3, ends 41 of the wires 28 at each edge 43, 44, 45, 46 of the top panel 12 remain rectilinear rather than being bent as are the loops 31 of the side panel 16. The ends 41 of the wires 28 at each edge 43–46 are attached by a cross wire 47 that provides the top panel 12 with a smooth perimeter. A major portion of the top panel 12 consists of interstices 48 of uniform size formed between the wires 28. However, certain marginal portions of the top panel 12 are provided with rows of interstices 49 smaller than the majority of uniformly sized interstices 48. The function of the small interstices 49 is described hereinafter. It will be understood that the bottom wall panel 13 is identical to the top wall panel 12 shown in FIG. 3 and, therefore, will not be described further.

Figure 4:
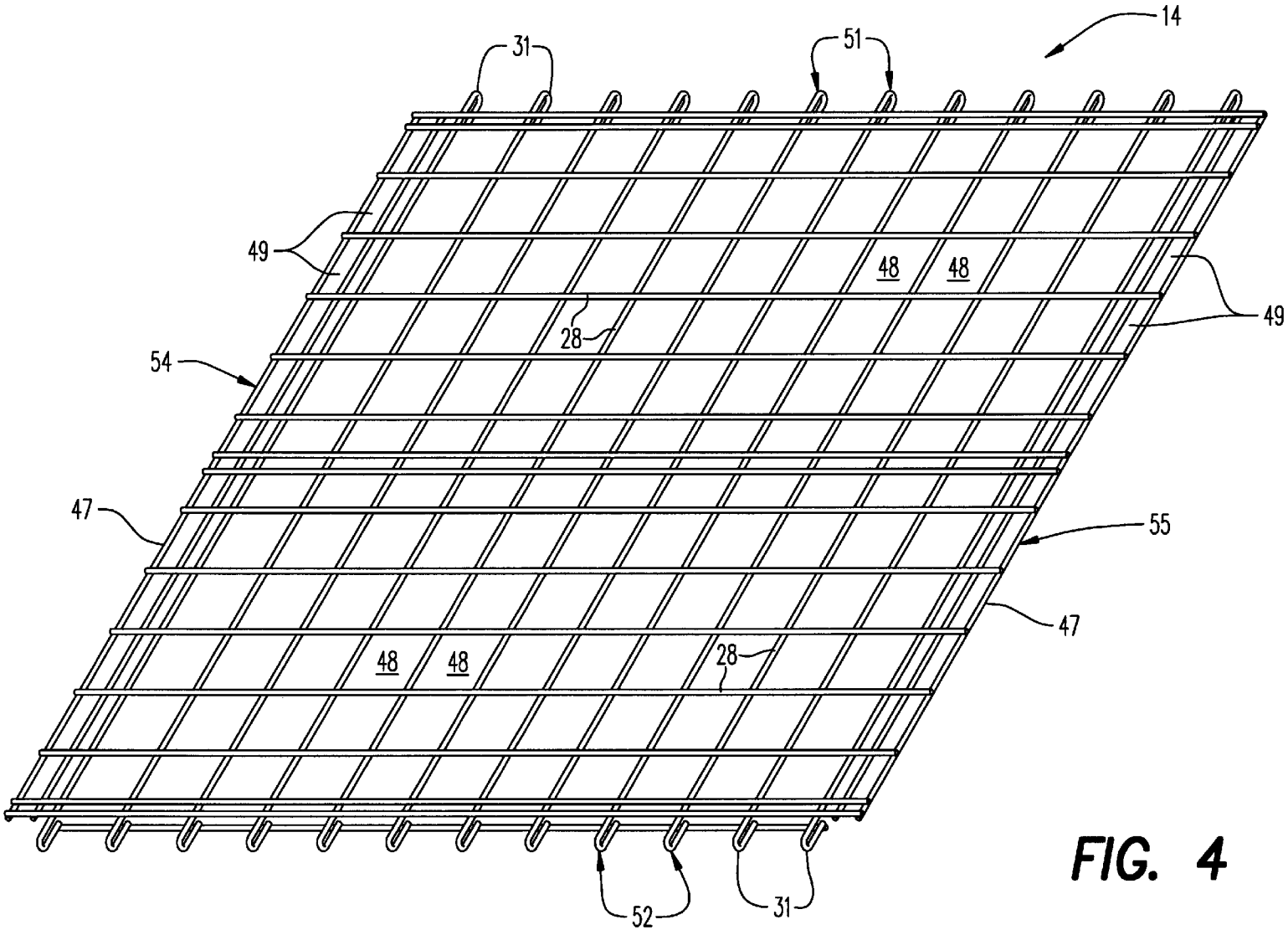
FIG. 4 is a front panel of the gabion shown in FIG. 1.

As illustrated in FIG. 4, the front wall panel 14 has an upper edge 51 and a lower edge 52 each formed with wire loops 31 in the manner described above for the side panels 16 and 17. Side edges 54, 55 are formed by cross wires 47 attached to contiguous rectilinear wire ends in the manner described above for the top and bottom panels 12, 13. As was the case for the top and bottom panels 12, 13, the front panel 14 has a majority of uniformly sized interstices 48 formed between the wires 28 and marginal portions having rows of smaller interstices 49. The back panel 15 is identical to the front panel 14 and will not be described further.

Figure 5:
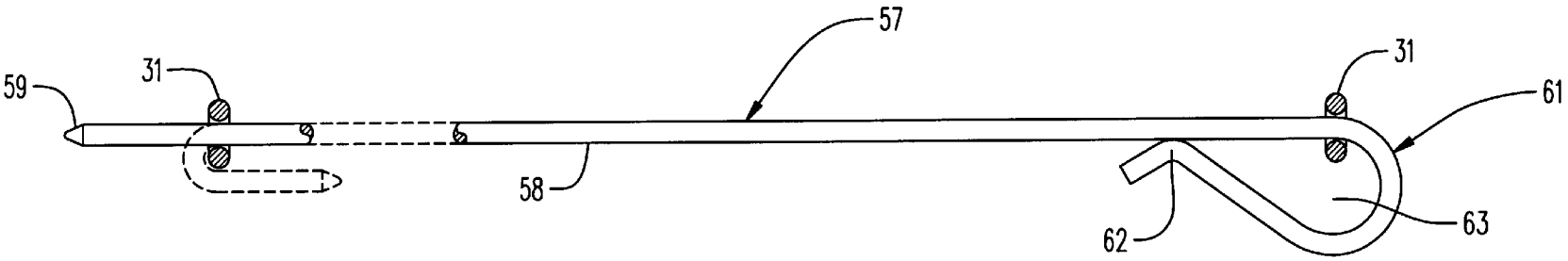
FIG. 5 is a plan view of a latch link component used with the gabion shown in FIG. 1.

A latch link component 57 is shown in FIG. 5 and includes an elongated shank 58 extending between a pointed end 59 and a resilient closed hook 61. An end 62 of the hook 61 resiliently engages the shank portion 58 and can be deformed therefrom to provide access to an interior 63 of the hook 61. Also as illustrated by dashed lines in FIG. 5, the pointed end 59 of the latch link 57 can be reversely bent for purposes described hereinafter.

Figure 6:
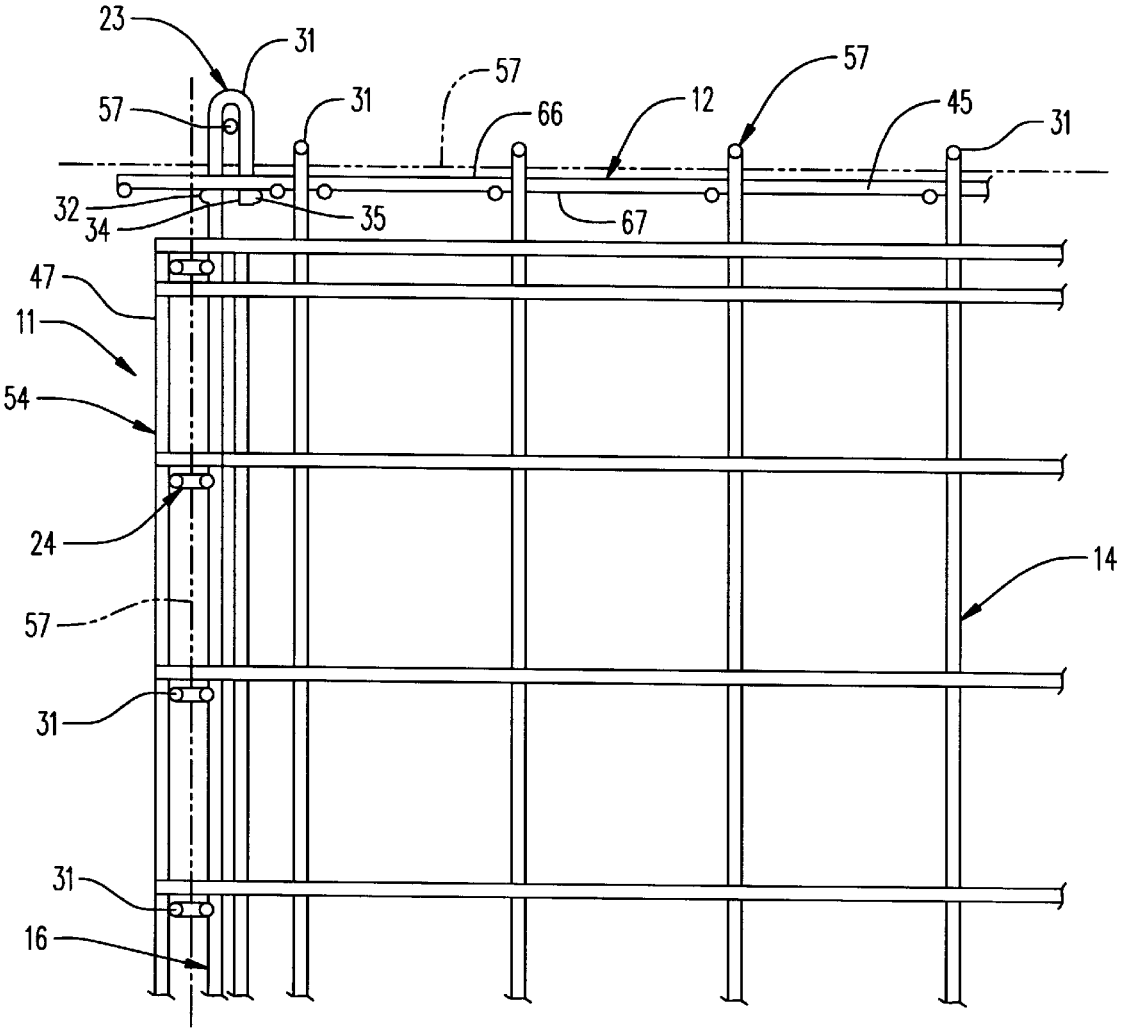
FIG. 6 is a front view of an upper left corner of the gabion shown in FIG. 1.

During assembly of the gabion 11, juxtaposed edges of the panels 12–17 are aligned and loops 31 formed along an edge of one panel are inserted through small interstices 49 along the edge of an adjacent panel. This assembly is partially illustrated for the upper left front corner of the gabion 11 in FIG. 6. Each loop 31 on the upper edge 23 of the side panel 16 is inserted through an aligned small interstice 49 along the left edge 46 of the top panel 12. After insertion, each loop 31 projects a given distance beyond the upper planar side 66 of the top panel 12 and the reentrant portion 34 of each loop 31 extends beyond the opposite bottom planar side of the top panel 12. In a similar manner, loops 31 along the right edge 24 of the side panel 16 are inserted through small interstices 49 along the left edge 54 of the front panel 14 and loops 31 along the top edge 51 thereof are inserted through small interstices 49 along the front edge 45 of the top panel 12.

After the loops 31 along the edge of one panel are inserted through small interstices in the juxtaposed edge of an adjacent panel, a latch link 57 is inserted through the aligned loops 31 extending along each joint of the gabion 11. The pointed end 59 of a link 57 is threaded through the aligned loops 31 along each joint 21 until the interior 63 of the deformed hook portion 61 receives the initial loop 31 as shown in FIG. 5. Return of the resilient end 62 into engagement with the shank portion 58 retains the link 57 in position around the aligned loop 31. The pointed end 59 of the latch link 57 then is bent back around the loop 31 (shown by dotted lines in FIG. 5) at the opposite end of the joint so as to prevent retraction of the link 57 from the aligned loops. To preserve clarity in FIG. 6, the installed latch links 57 are shown schematically by dotted lines.

After similar insertion of latch links 57 through loops 31 at each joint assembly of the gabion 11, each wall panel edge is securely attached to a juxtaposed edge of an adjacent panel. For example, engagement between top surface portions of the parallel wires 28 in the top wall 12 and the shank portions 58 of the latch links 57 received by the loops 31 along the upper edges 23, 51 of, respectively, the side panel 16 and the front panel 14 prevents one direction of movement of the top panel 12 relative to the side and front panels 16 and 14. Similarly, engagement between lower surface portions of the parallel wires 28 in the top panel 12 with the cross wire 32 and the retainer wire 35 prevents an opposite direction of relative movement between the top panel 12 and the side and front panels 16 and 14. In addition, engagement between lower surfaces of the wires 28 in the top panel 12 and the retainer wire 35 prevents either pivotal movement or deformation of the loops 31 on the edges of the front and side panels 14, 16. Such movement or deformation could create gaps that would accommodate transverse movement of the latch links 57 out of the loops 31. It will be appreciated that a latch link 57 will create similar secure attachments at other joints 21 of the gabion 11 including the joints between the top wall 12 and the front, back and side walls 14, 15 and 16; the joints between the bottom wall 13 and the front, back and side walls 14–17; the joints between the side wall 16 and the front and back walls 14, 15; and the joints between side wall 17 and the front and back walls 14, 15.

Figure 7:
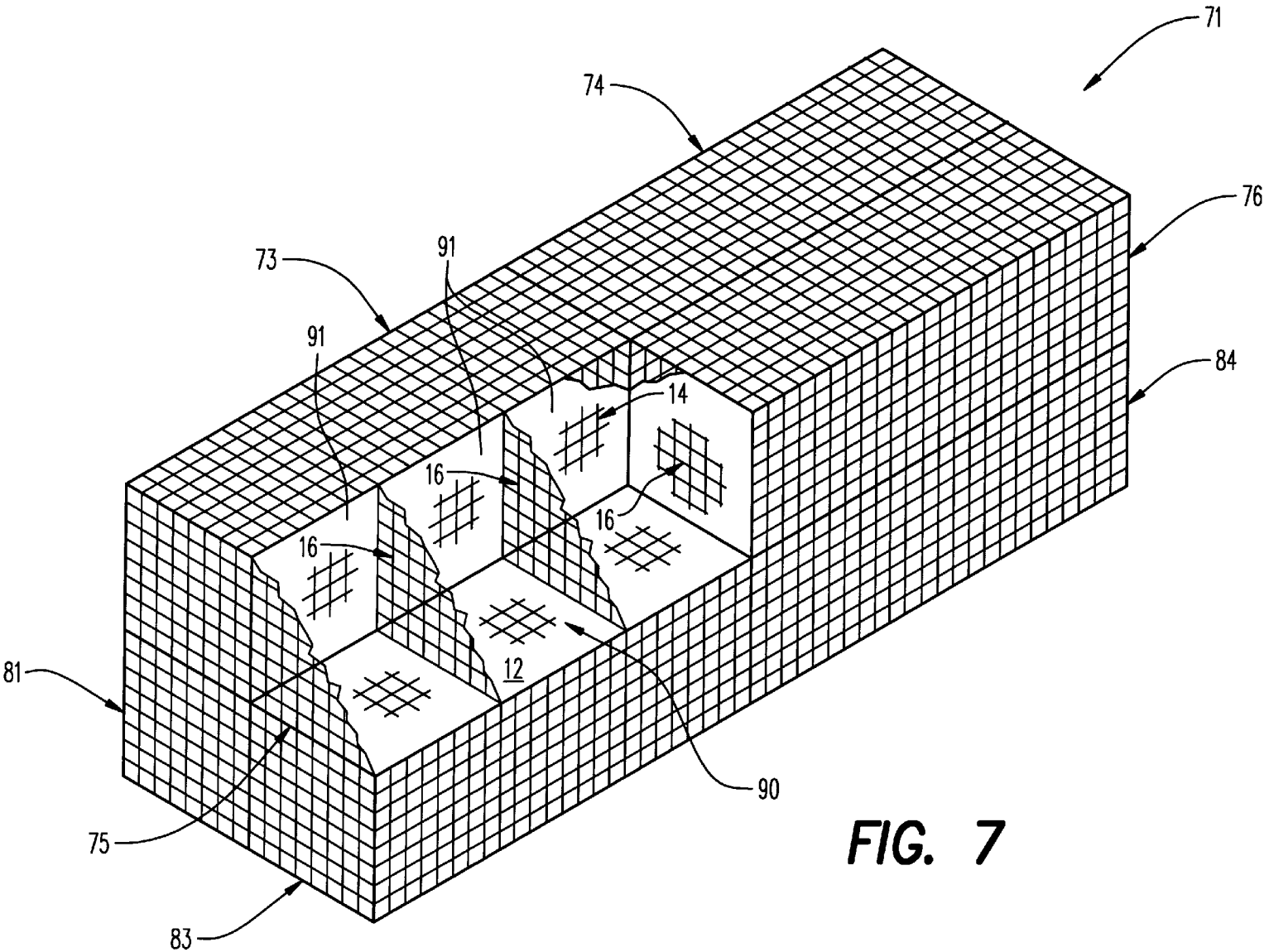
FIG. 7 is a diagramatic perspective view of a gabion assembly utilizing a plurality of gabions of the type shown in FIG. 1.

Depicted in FIG. 7 is a gabion assembly 71 formed with the wall panels 12, 14 and 16 shown in, respectively, FIGS. 3, 4 and 2. The assembly 71 includes four upper gabions 73–76 stacked on four lower gabions 81–84. Not shown in FIG. 7 is the lower gabion 82 disposed directly below the upper gabion 74. Each of the gabions 73–76 and 81–84 forms a chamber 90 and is constructed in a manner similar to the gabion 11 shown in FIG. 1. However, juxtaposed surfaces of adjacent gabions are formed by simple, common closure panels. For example, as shown in FIG. 7, a single front closure panel 14 (FIG. 4) forms both the front wall of the upper gabion 73 and the back wall of the upper gabion 75; a single top closure panel 12 (FIG. 3) forms both the bottom wall of the upper gabion 75 and the top wall of the lower gabion 83; and a single side wall closure panel 16 (FIG. 2) forms both the right side wall of the upper gabion 75 and the left side wall of the upper gabion 76. Other common walls of the gabions 73–76 and 81–84 are formed similarly by single closure panels 12, 14 and 16. Because of this shared wall construction, the wire material required for the assembly 71 is reduced substantially.

Figure 8:
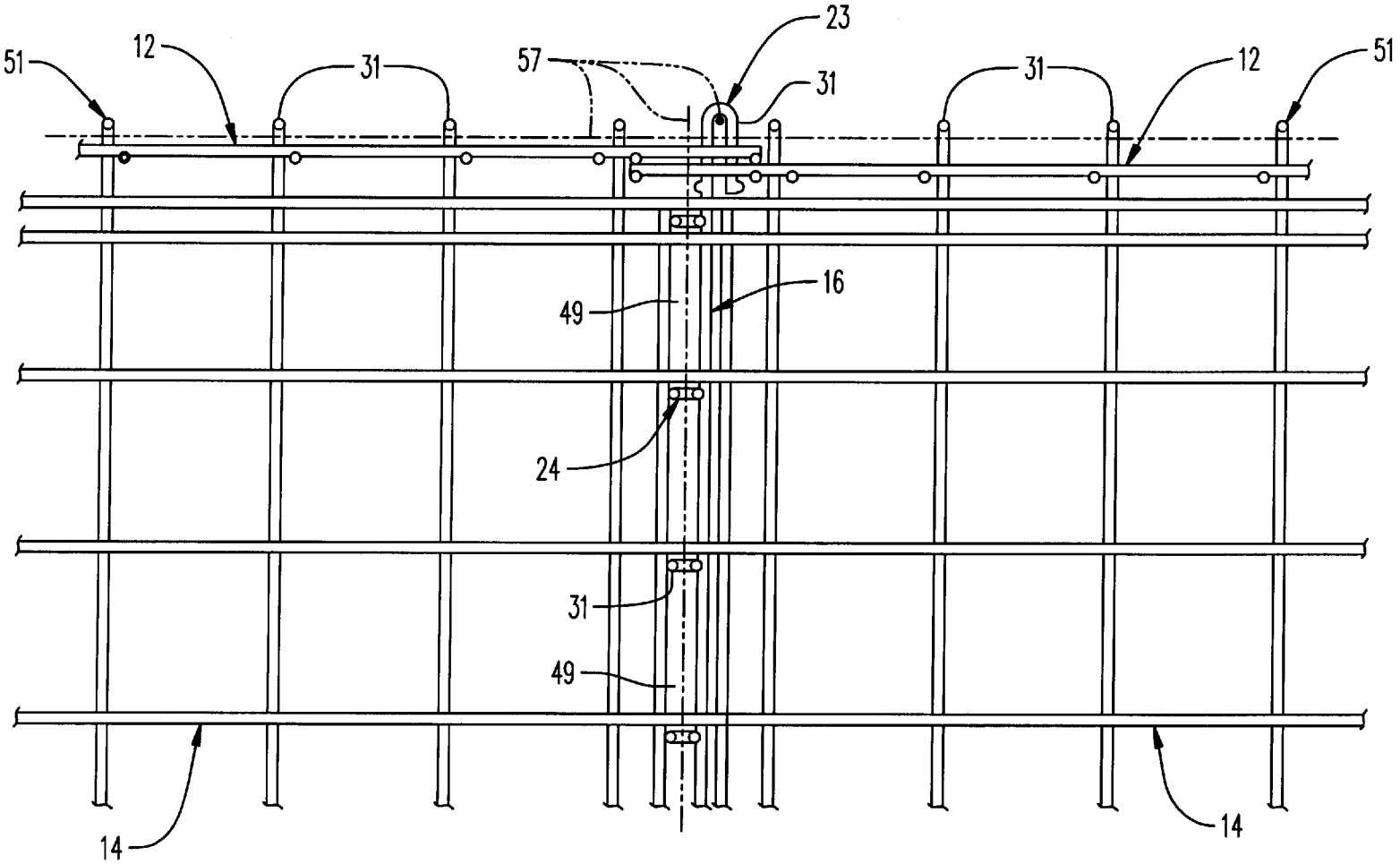
FIG. 8 is a front view showing a joint of the assembly illustrated in FIG. 7.

The manner in which a single panel 16 creates a common wall between the upper gabions 75 and 76 is illustrated in FIG. 8. Loops 31 on an upper edge 51 of a panel 14 penetrate small overlapped interstices 49 of top wall panels 12 of both the upper gabions 73 and 75, and loops 31 on an upper edge 51 of another panel 14 penetrate small overlapped interstices 49 of top wall panels 12 of both the upper gabions 74 and 76. Similarly, loops 31 on an upper edge 23 of a panel 16 penetrate overlapped small interstices 49 of top wall panels 12 of the upper gabions 75 and 76; loops 31 on, respectively, front 24 and rear 26 edges of the panel 16 penetrate overlapped small interstices 49 of, respectively, front and rear wall panels 14 of the upper gabions 75 and 76. It will be understood that loops 31 on the bottom edge 25 of the panel 16 similarly penetrate overlapped small interstices 49 of the common wall panels 12 of both the upper gabions 75 and 76 and the lower gabions 83 and 84; and loops 31 on the bottom edges 52 of the panels 14 penetrate, respectively, overlapped small interstices 49 the common wall panels 12 of, respectively, the upper and lower gabions 75 and 83 and the upper and lower gabions 76 and 84. The gabions 73–76 and 81–84 are secured together in the manner described above by insertion of latch links 57 through the loops 31 at each joint 21. To preserve clarity, the latch links 57 in FIG. 8 are shown schematically by dotted lines.

As illustrated in FIG. 7, each gabion enclosure 73–76 and 81–84 is divided into a plurality of distinct cavities 91 by divider wall panels identical to the side wall panel 16 shown in FIG. 2. The loops 31 on each edge of each divider panel 16 penetrate small interstices 49 of adjacent wall panels 12 and 14 and receive latch links 57 in the manner described above. Dividing each gabion enclosure into separate cavities 91 enhances the structural integrity of the gabion assembly 71 when filled with heavy aggregate material such as stone. To accommodate the loops 31 of the divider panels 16, each of the side wall panels 14 and top bottom wall panels 12 can be provided with intermediate rows of small interstices (not shown).

Obviously, many modifications and variations of the present invention are possible in light of the above teachings. It is to be understood, therefore, that the invention can be practiced otherwise than as specifically described.

What is claimed is:

1. A container comprising:

a plurality of wire mesh wall panels having substantially planar sides and arranged to form an enclosure, adjacent pairs of said panels each having a pair of juxtaposed panel edges attached along a joint;

one of said juxtaposed panel edges attached along at least some of said joints having wire ends forming loops each projecting a given distance beyond one planar side of an adjacent said planar panel and through a mesh interstice thereof; each said loop having a reentrant terminal portion extending back through said mesh interstice beyond an opposite planar side of said adjacent panel; and a latch link extending through said loops on said one side of said adjacent panel.

2. A container according to claim 1 including a retainer wire attaching said reentrant terminal portions on said opposite planar side of said adjacent panel.

3. A container according to claim 2 wherein wires forming said panels are dimensioned, shaped and arranged to provide a substantially rigid panel.

4. A container according to claim 3 wherein intersections of said wires are welded.

5. A container according to claim 4 wherein said wires are disposed in a substantially orthogonal relationship.

6. A container according to claim 2 wherein each of said joints comprises said loops.

7. A container according to claim 6 wherein said container is formed by six rectangular said panels arranged in an orthogonal relationship.

8. A container according to claim 7 wherein wires forming said panels are dimensioned, shaped and arranged to provide a substantially rigid panel.

9. A container according to claim 8 wherein intersections of said wires are welded, and said wires are disposed in a substantially orthogonal relationship.

10. A container according to claim 7 wherein said six panels comprise two said panels having said loops at all edges, two said panels having loops at two edges, and two said panels without loops.

11. A container according to claim 1 wherein each said panel has a substantial majority of interstices of uniform size, and said interstice receiving each said loop has a size substantially smaller than said uniform size.

12. A container according to claim 11 including a retainer wire attaching said reentrant terminal portions on said opposite planar side of said adjacent panel.

13. A container according to claim 12 wherein wires forming said panels are dimensioned, shaped and arranged to provide a substantially rigid panel.

14. A container according to claim 13 wherein said wires are disposed in a substantially orthogonal relationship.

15. A container according to claim 12 wherein each of said joints comprises said loops.

16. A container according to claim 15 wherein said container is formed by six rectangular said panels arranged in an orthogonal relationship.

17. A container according to claim 16 wherein said six panels comprise two said panels having said loops at all edges, two said panels having loops at two edges, and two said panels without loops.

18. A container according to claim 1 wherein said panels are orthogonally arranged rectangular panels, and said enclosure comprises distinct cavities separated by a rectangular wire mesh divider panel.

19. A container according to claim 18 including a retainer wire attaching said reentrant terminal portions on said opposite planar side of said adjacent panel.

20. A container according to claim 19 wherein each of said cavities is substantially cubic.

21. A container according to claim 20 wherein each edge of said divider panel has said loops forming a said joint.

22. A container according to claim 21 wherein each said wall panel has a substantial majority of interstices of uniform size, and said interstice receiving each said loop has a size substantially smaller than said uniform size.

23. A container according to claim 1 wherein said enclosure comprises adjacent chambers each formed by five orthogonally arranged said wall panels and having juxtaposed open ends closed by a single, rectangular wire mesh closure panel.

24. A container according to claim 23 including a retainer wire attached said reentrant terminal portions on said opposite planar side of said adjacent panel.

25. A container according to claim 24 wherein each of said joints comprises said loops.

26. A container according to claim 25 wherein each edge of said closure panel has said loops forming a said joint.

27. A container according to claim 26 wherein each said wall panel has a substantial majority of interstices of uniform size, and said interstice receiving each said loop has a size substantially smaller than said uniform size.

28. A container according to claim 27 wherein wires forming said panels are dimensioned, shaped and arranged to provide a substantially rigid panel.

29. A container according to claim 1 wherein said loops are formed along substantially the entire length of said one panel edge of each of said at least some said joints.

* * * * *